US010617920B2

(12) United States Patent
Nunez et al.

(10) Patent No.: US 10,617,920 B2
(45) Date of Patent: Apr. 14, 2020

(54) GOLF CLUB HEAD HAVING STRESS-REDUCING FEATURES

(71) Applicant: Callaway Golf Company, Carlsbad, CA (US)

(72) Inventors: Christopher A. G. Nunez, Escondido, CA (US); James A. Seluga, Carlsbad, CA (US); Matthew Myers, Carlsbad, CA (US); Denver Holt, Carlsbad, CA (US); Evan D. Gibbs, Encinitas, CA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

(21) Appl. No.: 16/380,897

(22) Filed: Apr. 10, 2019

(65) Prior Publication Data

US 2019/0232129 A1 Aug. 1, 2019

Related U.S. Application Data

(63) Continuation of application No. 15/812,674, filed on Nov. 14, 2017, now Pat. No. 10,258,846, which is a continuation-in-part of application No. 15/423,347, filed on Feb. 2, 2017, now abandoned, which is a continuation-in-part of application No. 15/385,549, filed on Dec. 20, 2016, now Pat. No. 9,776,058, which is a continuation-in-part of application No. 15/051,361, filed on Feb. 23, 2016, now Pat. No. 9,757,629, which is a continuation-in-part of application No. 14/997,799, filed on Jan. 18, 2016, now abandoned, which is a continuation-in-part of application No. 14/788,326, filed on Jun. 30, 2015, (Continued)

(51) Int. Cl.
*A63B 53/04* (2015.01)
*A63B 53/06* (2015.01)

(52) U.S. Cl.
CPC ..... *A63B 53/06* (2013.01); *A63B 2053/0454* (2013.01)

(58) Field of Classification Search
CPC ..... A63B 53/06; A63B 2053/0454
USPC ..... 473/324, 335, 329, 330, 334, 340, 342
See application file for complete search history.

(56) References Cited

U.S. PATENT DOCUMENTS 2,386,552 A * 10/1945 Hill ..... A63B 53/06 473/245
3,368,812 A * 2/1968 Baldwin, Sr. ..... A63B 53/04 473/330

(Continued)

*Primary Examiner* — William M Pierce
(74) *Attorney, Agent, or Firm* — Rebecca Hanovice; Michael Catania; Sonia Lari

(57) ABSTRACT

A golf club head comprising a body and a stiffening structure is disclosed herein. The body comprises a face section, a sole section, and a crown section, and defines a hollow interior. The stiffening structure extends within the hollow interior from the crown section to the sole section to reduce stresses placed on the face section during impact with a golf ball. The stiffening structure is entirely located within 0.500 inch of a rear surface of the face section measured along a plane normal to the center of the face, and within 1 inch of the center of the face section along a horizontal axis parallel to the face section, and comprises heel and toe connectors connected to one another by a middle connector, such that the stiffening structure has an approximately X- or H-overall shape.

20 Claims, 7 Drawing Sheets

Related U.S. Application Data now Pat. No. 9,597,558, and a continuation-in-part of application No. 14/794,578, filed on Jul. 8, 2015, now Pat. No. 9,814,947, which is a continuation-in-part of application No. 14/755,068, filed on Jun. 30, 2015, now Pat. No. 9,623,302, which is a continuation-in-part of application No. 14/498,843, filed on Sep. 26, 2014, now Pat. No. 9,259,627, which is a continuation-in-part of application No. 14/173,615, filed on Feb. 5, 2014, now Pat. No. 9,180,349, which is a continuation-in-part of application No. 14/039,102, filed on Sep. 27, 2013, now Pat. No. 8,834,294, which is a continuation of application No. 13/797,404, filed on Mar. 12, 2013, now abandoned.

(60) Provisional application No. 61/898,956, filed on Nov. 1, 2013, provisional application No. 61/665,203, filed on Jun. 27, 2012, provisional application No. 61/684,079, filed on Aug. 16, 2012.

(56) References Cited

U.S. PATENT DOCUMENTS 3,652,094 A * 3/1972 Glover ..... A63B 53/08 473/337
4,618,149 A * 10/1986 Maxel ..... A63B 53/06 473/245
4,938,470 A * 7/1990 Antonious ..... A63B 53/04 473/242
5,067,715 A * 11/1991 Schmidt ..... A63B 53/04 473/332
5,141,231 A * 8/1992 Cox ..... A63B 53/0466 473/330
5,180,166 A * 1/1993 Schmidt ..... A63B 53/04 473/332
5,397,126 A * 3/1995 Allen ..... A63B 53/04 473/324
5,467,983 A * 11/1995 Chen ..... A63B 53/04 473/342
5,505,453 A * 4/1996 Mack ..... A63B 53/04 473/329
5,533,729 A * 7/1996 Leu ..... A63B 53/04 473/346
5,547,194 A * 8/1996 Aizawa ..... A63B 53/04 473/350
5,564,994 A * 10/1996 Chang ..... A63B 53/04 473/342
5,669,826 A * 9/1997 Chang ..... A63B 53/04 473/332
5,718,641 A * 2/1998 Lin ..... A63B 53/04 473/224
5,941,782 A * 8/1999 Cook ..... A63B 53/04 473/346
6,030,295 A * 2/2000 Takeda ..... A63B 53/04 473/345
6,306,048 B1 * 10/2001 McCabe ..... A63B 53/04 473/333
6,319,150 B1 * 11/2001 Werner ..... A63B 53/04 473/349
6,695,714 B1 * 2/2004 Bliss ..... A63B 53/047 473/328
6,852,038 B2 * 2/2005 Yabu ..... A63B 53/04 473/224
7,771,291 B1 * 8/2010 Willett ..... A63B 53/06 473/337
7,914,393 B2 * 3/2011 Hirsch ..... A63B 53/0466 473/332
8,834,294 B1 * 9/2014 Seluga ..... A63B 53/04 473/338
8,956,244 B1 * 2/2015 Westrum ..... A63B 53/04 473/338
8,961,336 B1 * 2/2015 Parsons ..... A63B 53/0475 473/332
9,067,110 B1 * 6/2015 Seluga ..... A63B 53/0466
9,162,115 B1 * 10/2015 Beach ..... A63B 53/04
9,199,140 B1 * 12/2015 Schweigert ..... A63B 53/0466
9,486,677 B1 * 11/2016 Seluga ..... A63B 53/0466
9,597,558 B1 * 3/2017 Seluga ..... A63B 53/0466
9,597,561 B1 * 3/2017 Seluga ..... A63B 53/06
9,687,701 B1 * 6/2017 Seluga ..... A63B 53/0466
9,687,702 B1 * 6/2017 Seluga ..... A63B 53/0466
9,694,257 B1 * 7/2017 Seluga ..... A63B 53/0475
9,757,629 B2 * 9/2017 Seluga ..... A63B 53/0466
9,776,058 B2 * 10/2017 Seluga ..... A63B 53/0466
9,782,646 B2 * 10/2017 Seluga ..... A63B 53/0466
9,814,947 B1 * 11/2017 Seluga ..... A63B 53/0466
9,821,199 B1 * 11/2017 Seluga ..... A63B 53/0466
9,889,349 B1 * 2/2018 Seluga ..... A63B 53/0466
9,901,792 B2 * 2/2018 Franklin ..... A63B 53/04
9,937,390 B2 * 4/2018 Luttrell ..... A63B 53/06
9,950,219 B2 * 4/2018 Larson ..... A63B 53/0466
10,046,211 B2 * 8/2018 Franklin ..... A63B 53/0487
10,130,849 B2 * 11/2018 Franklin ..... A63B 53/06
10,238,933 B1 * 3/2019 Seluga ..... A63B 53/06
10,369,435 B1 * 8/2019 Myers ..... F16G 11/12
10,518,146 B2 * 12/2019 Myers ..... F16G 11/12
2001/0001774 A1 * 5/2001 Antonious ..... A63B 53/04 473/349
2002/0137576 A1 * 9/2002 Dammen ..... A63B 53/04 473/336
2003/0176231 A1 * 9/2003 Hasebe ..... A63B 53/04 473/291
2008/0119303 A1 * 5/2008 Bennett ..... A63B 60/00 473/338
2010/0267463 A1 * 10/2010 Stites ..... A63B 53/047 473/291
2011/0124432 A1 * 5/2011 Oldknow ..... A63B 53/047 473/334
2011/0312437 A1 * 12/2011 Sargent ..... A63B 53/02 473/335
2012/0165115 A1 * 6/2012 Matsunaga ..... A63B 53/04 473/336
2012/0289360 A1 * 11/2012 Breier ..... A63B 53/047 473/335
2014/0080634 A1 * 3/2014 Golden ..... A63B 60/00 473/345
2015/0094166 A1 * 4/2015 Taylor ..... A63B 53/0466 473/335
2015/0231454 A1 * 8/2015 Parsons ..... A63B 53/0475 473/335
2015/0231806 A1 * 8/2015 Parsons ..... A63B 53/0475 264/261
2015/0367198 A1 * 12/2015 Seagram ..... A63B 53/047 473/349
2016/0059090 A1 * 3/2016 Parsons ..... A63B 53/0466 473/338
2016/0166893 A1 * 6/2016 Akiyama ..... A63B 53/0466 473/335
2016/0310809 A1 * 10/2016 Boggs ..... A63B 60/02
2016/0317880 A1 * 11/2016 Boggs ..... A63B 60/02
2016/0367876 A1 * 12/2016 Taylor ..... A63B 53/047
2017/0072277 A1 * 3/2017 Mata ..... A63B 53/06
2018/0028879 A1 * 2/2018 Ines ..... A63B 53/047
2018/0028882 A1 * 2/2018 Hebreo ..... A63B 53/08
2019/0091524 A1 * 3/2019 Slaughter ..... A63B 53/04
2019/0168087 A1 * 6/2019 Martens ..... A63B 53/0475
2019/0232129 A1 * 8/2019 Nunez ..... A63B 53/06

* cited by examiner

GOLF CLUB HEAD HAVING STRESS-REDUCING FEATURES

CROSS REFERENCES TO RELATED APPLICATIONS

The present invention is a continuation of U.S. patent application Ser. No. 15/812,674, filed on Nov. 14, 2017, and issued on Apr. 16, 2019, as U.S. Pat. No. 10,258,846, which is a continuation-in-part of U.S. patent application Ser. No. 15/423,347, filed on Feb. 2, 2017, now abandoned, which is a continuation-in-part of U.S. patent application Ser. No. 15/385,549, filed on Dec. 20, 2016, and issued on Oct. 3, 2017, as U.S. Pat. No. 9,776,058, which is a continuation-in-part of U.S. patent application Ser. No. 15/051,361, filed on Feb. 23, 2016, and issued on Sep. 12, 2017, as U.S. Pat. No. 9,767,629, which is a continuation-in-part of U.S. patent application Ser. No. 14/997,199, filed on Jan. 15, 2016, now abandoned, which is a continuation-in-part of U.S. patent application Ser. No. 14/788,326, filed on Jun. 30, 2015, and issued on Mar. 21, 2017, as U.S. Pat. No. 9,597,558, and which is also a continuation-in-part of U.S. patent application Ser. No. 14/794,578, filed on Jul. 8, 2015, and issued on Nov. 14, 2017, as U.S. Pat. No. 9,814,947, which is a continuation-in-part of U.S. patent application Ser. No. 14/755,068, filed on Jun. 30, 2015, and issued on Apr. 18, 2017, as U.S. Pat. No. 9,623,302, which is a continuation-in-part of U.S. patent application Ser. No. 14/498,843, filed on Sep. 26, 2014, and issued on Feb. 16, 2016, as U.S. Pat. No. 9,259,627, which is a continuation-in-part of U.S. patent application Ser. No. 14/173,615, filed on Feb. 5, 2014, and issued on Nov. 10, 2015, as U.S. Pat. No. 9,180,349, which claims priority to U.S. Provisional Patent Application No. 61/898,956, filed on Nov. 1, 2013, and which is a continuation-in-part of U.S. patent application Ser. No. 14/039,102, filed on Sep. 27, 2013, and issued on Sep. 16, 2014, as U.S. Pat. No. 8,834,294, which is a continuation of U.S. patent application Ser. No. 13/797,404, filed on Mar. 12, 2013, now abandoned, which claims priority to U.S. Provisional Patent Application No. 61/665,203, filed on Jun. 27, 2012, and 61/684,079, filed on Aug. 16, 2012, the disclosure of each of which is hereby incorporated by reference in its entirety herein.

STATEMENT REGARDING FEDERALLY SPONSORED RESEARCH OR DEVELOPMENT

Not Applicable

BACKGROUND OF THE INVENTION

Field of the Invention

The present invention relates to a golf club head. More specifically, the present invention relates to a golf club head with an internal stiffening structure connecting a crown portion with a sole portion and disposed proximate a striking face section.

Description of the Related Art

The prior art discloses various golf club heads having interior structures. For example, Yabu, U.S. Pat. No. 6,852,038 for a Golf Club Head And Method Of Making The Same, discloses a golf club head with a sound bar, Galloway, U.S. Pat. No. 7,118,493 for a Multiple Material Golf Club Head discloses a golf club head with a composite aft body having an interior sound component extending upward from a sole section of a metal face component, Seluga et al., U.S. Pat. No. 8,834,294 for a Golf Club Head With Center Of Gravity Adjustability discloses a golf club head with a tube having a mass for adjusting the CG of a golf club head, and Dawson et al., U.S. Pat. No. 8,900,070 for a Weighted Golf Club Head discloses a golf club head with an interior weight lip extending from the sole towards the face. However, the prior art fails to disclose an interior structure that increases ball speed through reducing stress in the striking face section at impact, with a minimal increase in mass to the golf club head.

BRIEF SUMMARY OF THE INVENTION

The golf club head comprises a stiffening structure connecting a crown section to a sole section to reduce the stress in a striking face section during impact with a golf ball. In some embodiments, the stiffening structure is an X- or H-shaped structure.

One aspect of the present invention is a golf club head comprising a body comprising a striking face section, a sole section, a return section, and an upper opening, the return section extending away from an upper edge of the striking face section and disposed between the striking face section and the upper opening, a crown section disposed on the body to close the upper opening and define a hollow interior, and a stiffening structure comprising a heel side connector, a toe side connector, and a middle connector, wherein the striking face section comprises a face center and a rear face surface facing the hollow interior, and wherein each of the heel side connector and toe side connector extends from the return section to the sole section approximately parallel with the rear face surface within the hollow interior without contacting the rear face surface, wherein the middle connector connects the heel side connector to the toe side connector, wherein the entire stiffening structure is located a first distance of less than 0.500 inch from the rear face surface, wherein the first distance is measured along a plane extending through face center, the plane extending along a vertical Z-axis and a horizontal X-axis extending perpendicular to the striking face section, and wherein the stiffening structure reduces stress placed on the striking face section when the striking face section impacts a golf ball.

In some embodiments, the stiffening structure may have a shape selected from the group consisting of X-shape and H-shape. For example, the middle connector may extend approximately perpendicular to the heel side and toe side connectors. In other embodiments, the middle connector may comprise a central section and a plurality of trusses, and each of which may extend at an angle of less than 90° with respect to at least one of the heel side connector and the toe side connector. In still other embodiments, the stiffening structure may have a mass of less than 10 grams.

In some embodiments, each of the heel side and toe side connector may be a linear rod, and the heel side connector may extend approximately parallel with the toe side connector along the vertical Z-axis. In other embodiments, each of the heel and toe side connectors may be located a second distance of no more than 1 inch away from the center of the face, the second distance measured along a Y-axis extending parallel with the face and perpendicular to the X and Z axes. In a further embodiment, the second distance may be variable, such that portions of the heel and toe side connectors extend towards or away from one another. In still other embodiments, at least one of the heel side and toe side connector may comprise a curvature, and in a further embodiment, at a portion of the heel side connector may curve towards the toe side connector, and a portion of the toe side connector may curve towards the heel side connector. In a further embodiment, the middle connector may be a plate comprising at least one through-hole.

In other embodiments, the return section may comprise a heel side aperture and a toe side aperture, an upper end of the heel side connector may be disposed within the heel side aperture, and an upper end of the toe side connector may be disposed within the toe side aperture. In still other embodiments, the golf club head may comprise heel and toe side bosses extending from the sole section into the hollow interior, a lower end of the heel side connector may be received within the heel side boss, and a lower end of the toe side connector may be received within the toe side boss. In any of the embodiments, a portion of the middle connector may be aligned with the face center along the X-axis. In some embodiments, each of the heel side and toe side connectors may be a solid cylindrical rod, and in a further embodiment, the middle connector may be a thin plate comprising first and second triangular cutouts.

Another aspect of the present invention is a wood-type golf club head comprising a body comprising a striking face section, a sole section, and a crown section, and a stiffening structure comprising a heel side connector, a toe side connector, and a middle connector, wherein the striking face section comprises a face center and a rear face surface facing the hollow interior, and wherein each of the heel side connector and toe side connector extends from the crown section to the sole section approximately parallel with the rear face surface within the hollow interior without contacting the rear face surface, wherein a portion of the heel side connector curves towards the toe side connector and a portion of the toe side connector curves towards the heel side connector, wherein the middle connector connects the heel side connector to the toe side connector, wherein the entire stiffening structure is located a first distance of less than 0.433 inch from the rear face surface, wherein the first distance is measured along a plane extending through face center, the plane extending along a vertical Z-axis and a horizontal X-axis extending perpendicular to the striking face section, wherein each of the heel and toe connectors is located a second distance of no more than 1 inch away from the center of the face, the second distance measured along a Y-axis extending parallel with the face and perpendicular to the X and Z axes, wherein the stiffening structure comprises a mass of less than 10 grams, and wherein the stiffening structure reduces stress placed on the striking face section when the striking face section impacts a golf ball. In some embodiments, a portion of the middle connector may be aligned with the face center along the X-axis. In other embodiments, the middle connector may be a plate comprising at least one through-hole, which may have a triangular shape.

Having briefly described the present invention, the above and further objects, features, and advantages thereof will be recognized by those skilled in the pertinent art from the following detailed description of the invention when taken in conjunction with the accompanying drawings.

DETAILED DESCRIPTION OF THE INVENTION

Figure 1:
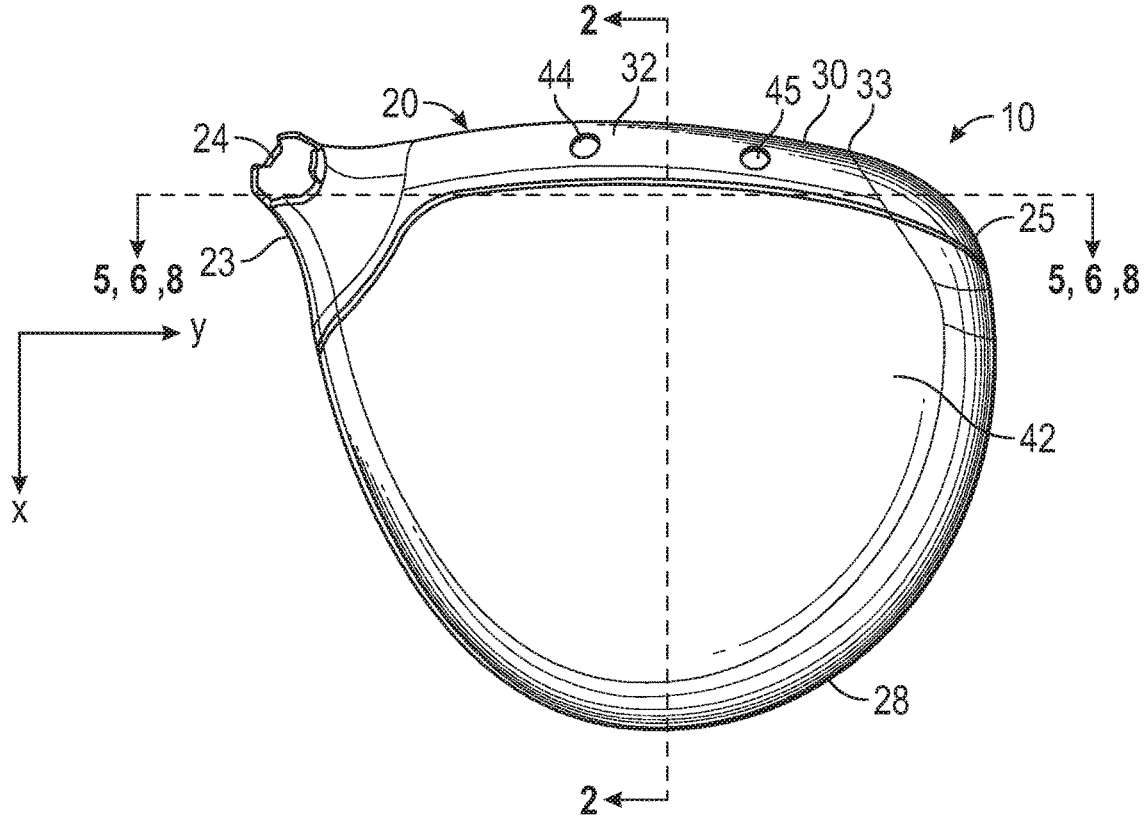
FIG. 1 is a top plan view of a golf club head of the present invention.

FIGS. 1-8 illustrate several embodiments of the golf club head 10 of the present invention. The golf club head 10 includes a body 20 having a striking face section 30, a sole section 22 extending from a lower edge 31 of the striking face section 30, a return section 32 extending away from an upper edge 33 of the striking face section 30, a hosel 24 for engaging a shaft, a heel end 23, a toe end 25, an upper opening 26, a hollow interior 27, and an aft end 28. A crown section 40 is comprised of the return section 32 and a crown insert 42 that is placed over the upper opening 26, and permanently affixed to the body 20, to enclose the hollow interior 27.

Figure 2:
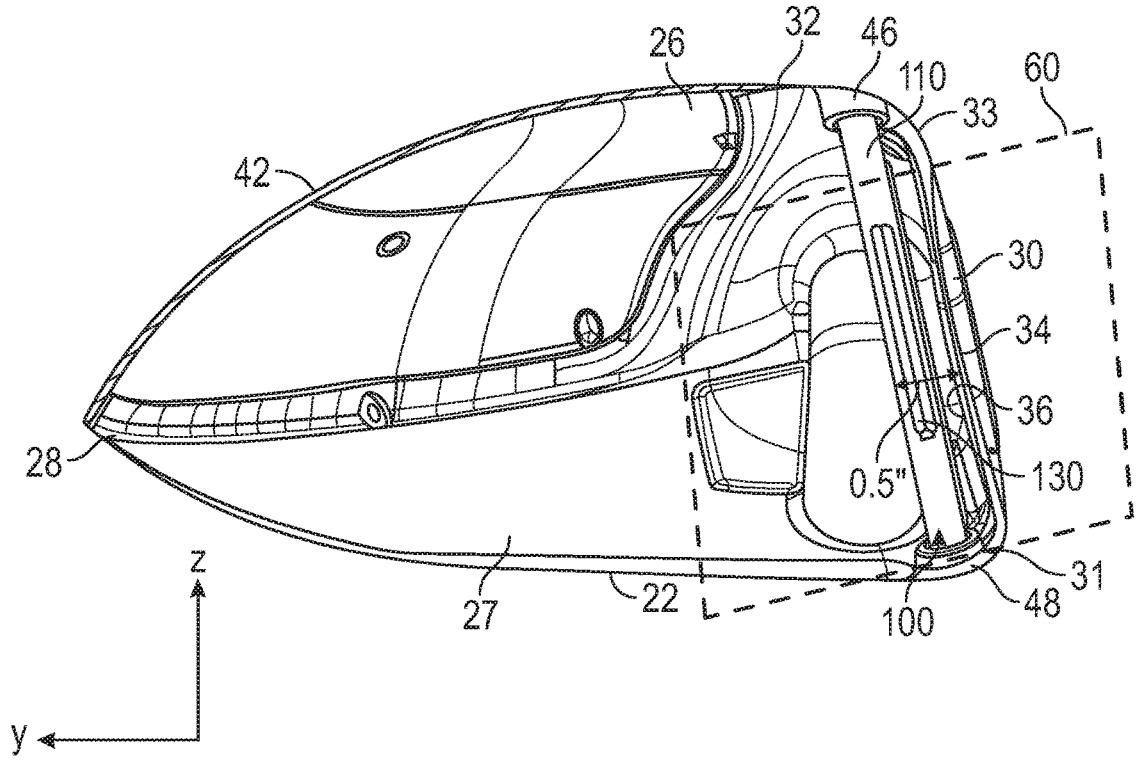
FIG. 2 is a cross-sectional view of the golf club head shown in FIG. 1 along lines 2-2.

Within the hollow interior 27, a stiffening structure 100 extends from the sole section 22 upward to the return section 32. In an alternative embodiment, the stiffening structure 100 may extend to the crown insert 42 instead, and in another, alternative embodiment, the body 20 may lack an upper opening 26 entirely and the crown section 40 may extend from the upper edge 33 of the striking face section all the way to the aft end 28; what is important is that, as shown in FIG. 2, the stiffening structure 100 connects the crown section 40 to the sole section 22 in close proximity to the rear surface 36 of the striking face section 30 without making contact with any portion of the striking face section 30, including the rear surface 36, even during impact with a golf ball.

As shown in FIGS. 3-7, the stiffening structure 100 of the present invention comprises a heel side connector 110 extending between the return section 32 and the sole section 22 proximate the heel end 23, a toe side connector 120 extending between the return section 32 and the sole section 22 proximate the toe end 25, and a middle connector 130 extending between, and connecting, the heel side connector 110 and the toe side connector 120. The upper end 112 of the heel side connector 110 engages a first aperture 44 extending through the return section 32, while the upper end 122 of the toe side connector 120 engages a second aperture 45 extending through the return section 32 (or, in an alternative embodiment, the crown insert 42). As shown in FIG. 2, the apertures extend through bosses 46 that extend into the hollow interior 27 and provide additional support to the heel and toe side connectors 110, 120. The lower end of the heel side connector 110 is disposed within, and abuts a portion of, a first boss 48 that extends upwards from the sole section 22 into the hollow interior 27, and the lower end of the toe side connector is disposed within, and abuts a portion of, a second boss 49 that also extends upwards from the sole section 22 into the hollow interior 27. The orientation of the first and second apertures 44, 45 and the bosses 48, 49 may, in an alternative embodiment, be reversed so that the first and second apertures 44, 45 extend through the sole section 22 and the closed bosses 48, 49 extend into the hollow interior from the return section 32.

In each embodiment, at least a portion of the middle connector 130 is aligned with the center 34 of the striking face section 30 along a horizontal X-axis extending through the face center 34 perpendicular to the striking face section 30 (e.g., in a face-aft direction), and the middle connector 130 does not make contact with the upper ends 112, 122 or lower ends 114, 124 of the heel and toe side connectors 110, 120, instead connecting with the middle portions 116, 126 of the heel and toe side connectors 110, 120 that are suspended within the hollow interior 27 of the golf club head 10. The middle connector 130 thereby provides structural support for the heel and toe side connectors 110, 120.

Figure 3:
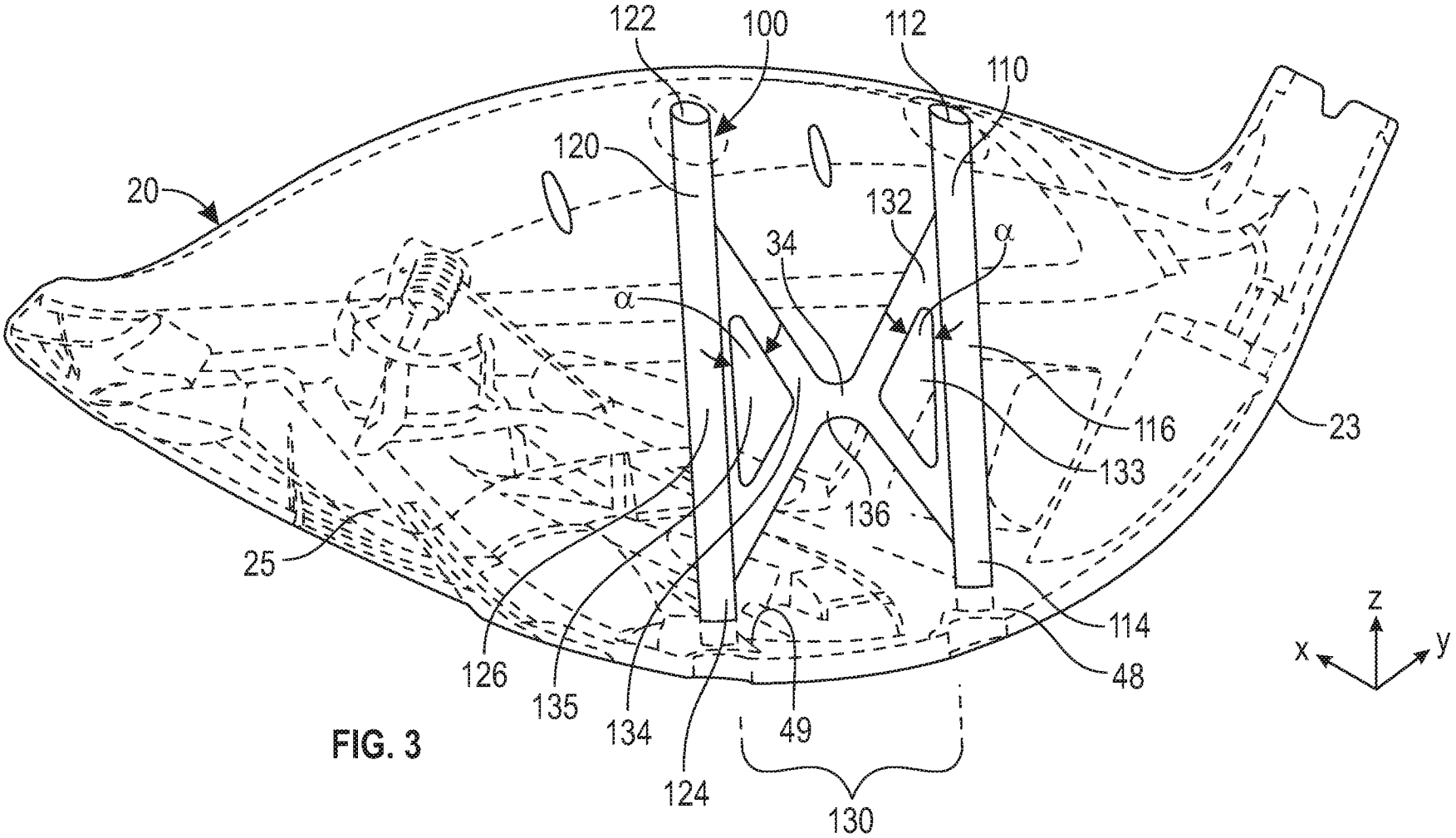
FIG. 3 is a front perspective, partially transparent view of the golf club head shown in FIG. 1.
Figure 4:
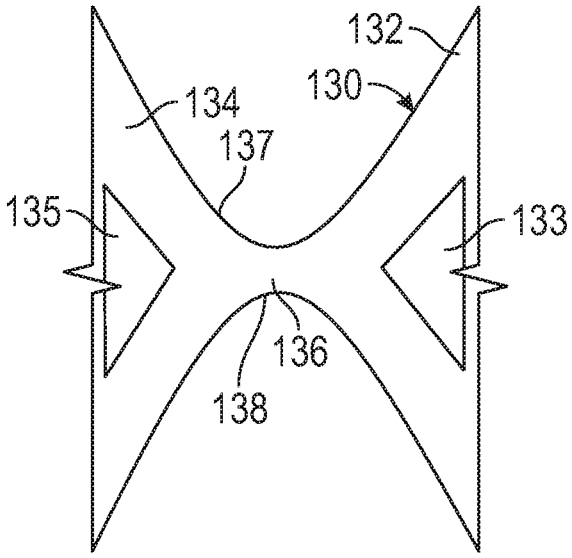
FIG. 4 is a line drawing of an alternative embodiment of a portion of the stiffening structure shown in FIG. 3.

In the embodiment shown in FIG. 3, the middle connector 130 comprises two trusses 132, 134 oriented in an X-shape, or a thin plate defining two triangular cutouts 133, 135 on either side of a central connection region 136. In an alternative embodiment, shown in FIG. 4, curvature is introduced into the X-shape along the upper and lower edges 137, 138 of the middle connector such that the central connection region 136 is elongated along the Y-axis extending parallel to the striking face section 30 and perpendicular to the X and Z axes. By doing so, some of the mass of each of the trusses 132, 134 is moved heel- and toe-wards away from the face center 34 and towards the heel side and toe side connectors 110, 120. In each of these embodiments, the trusses 132, 134 extend at an angle $\alpha$ of less than 90° with respect to the heel and toe side connectors 110, 120, measured from within the triangular cutouts 133, 135.

Figure 5:
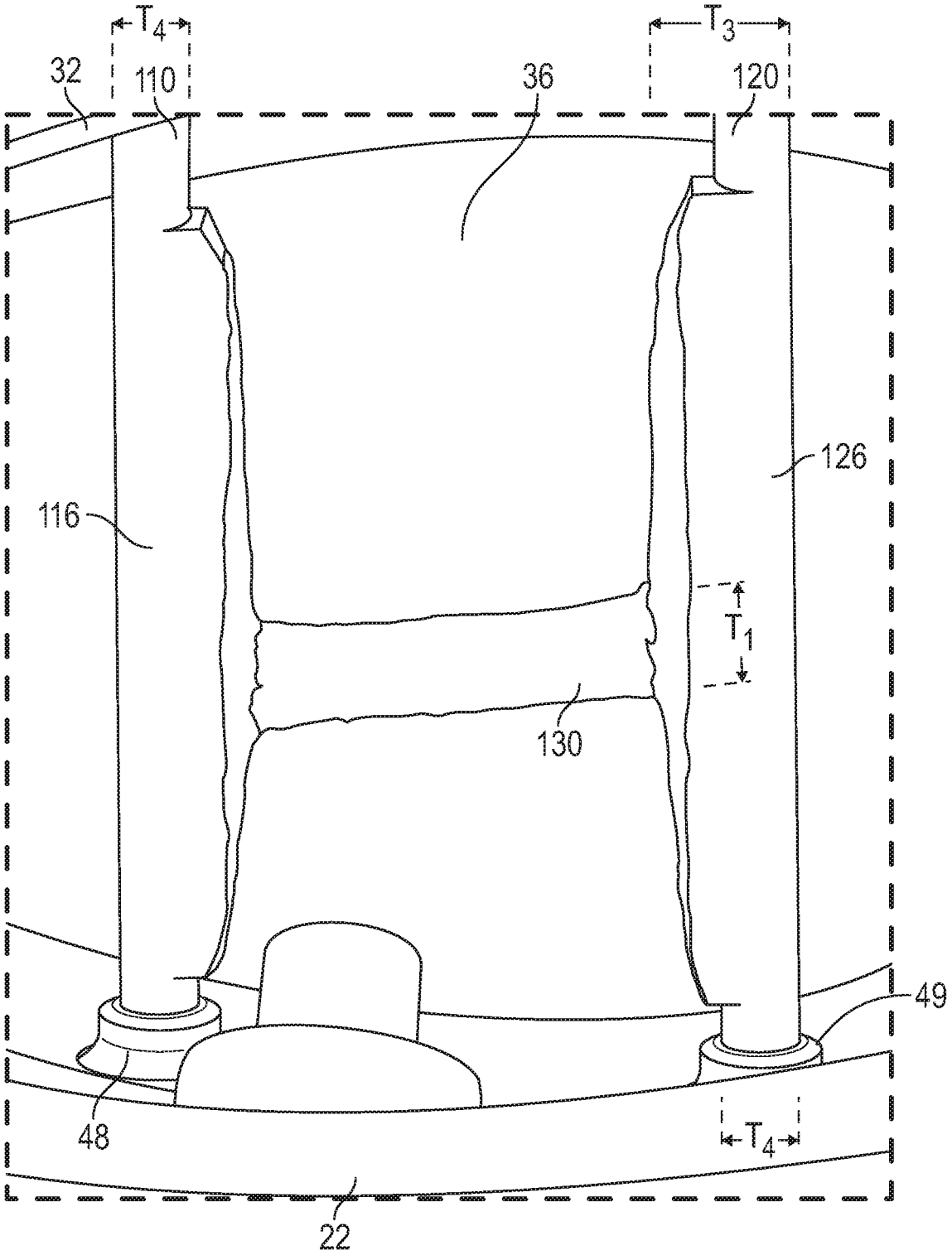
FIG. 5 is a cross-sectional view of the golf club head shown in FIG. 1 along lines 5-5 with an alternative embodiment of the stiffening structure of the present invention.
Figure 6:
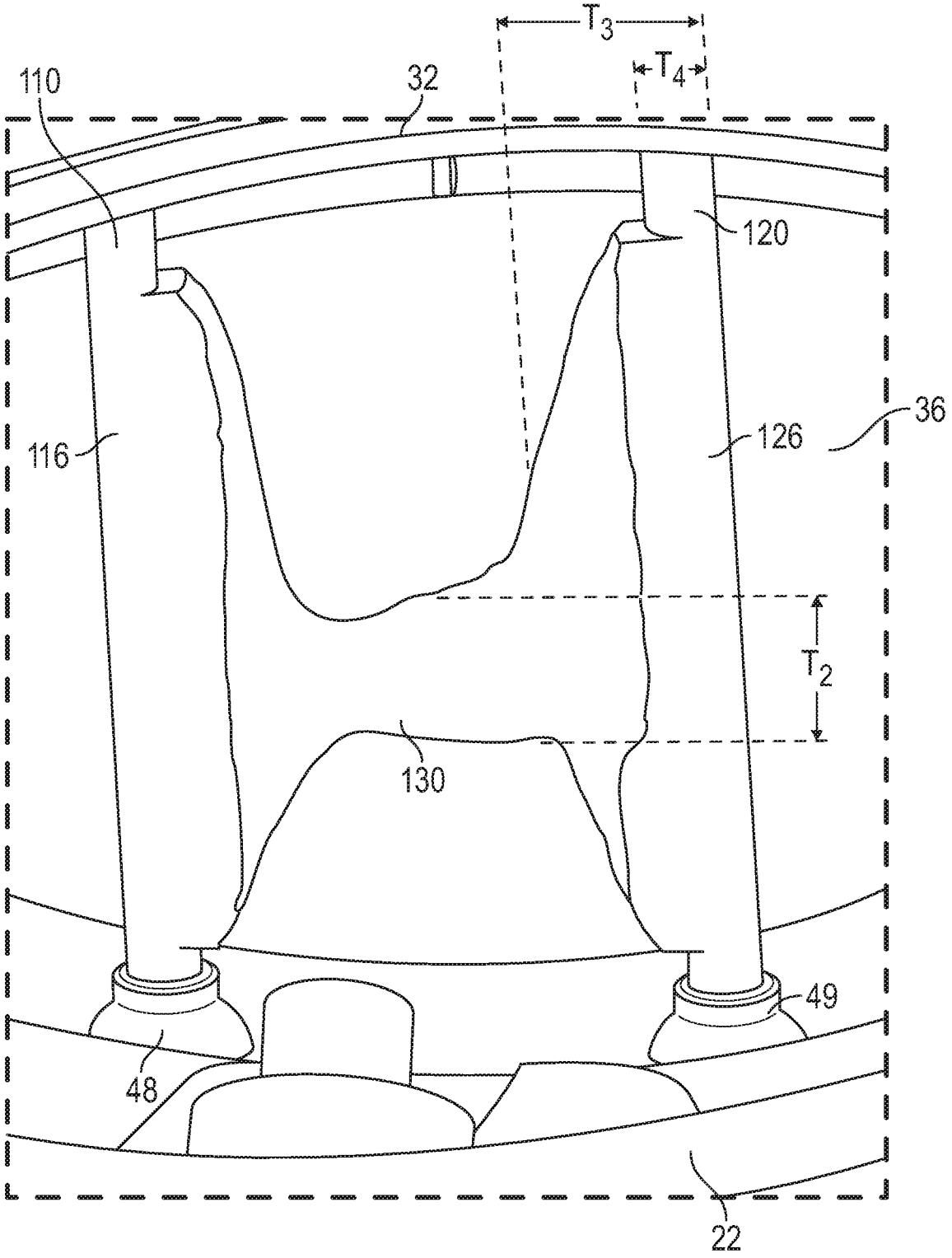
FIG. 6 is a cross-sectional view of the golf club head shown in FIG. 1 along lines 6-6 with another, alternative embodiment of the stiffening structure of the present invention.

In the embodiments shown in FIGS. 5 and 6, the middle connector 130 is a single bar extending approximately perpendicular to each of the heel and toe side connectors 110, 120, such that the stiffening structure 100 has an overall H-shape. In FIG. 5, the middle connector 130 has an approximately constant thickness $T_1$, while in FIG. 6, the middle connector 130 has a variable thickness $T_2$ along its Y-axis length to optimize mass distribution within the stiffening structure 100. Each of the heel and toe side connectors 110, 120 has greater thickness $T_3$ at its middle portion 116, 126 than at its upper ends 112, 122 and lower ends 114, 124 $T_4$, and the thickness $T_3$ at the middle portion 116, 126 may also vary across the length of the heel and toe side connectors 110, 120 as shown in FIG. 6.

In the embodiments shown in FIGS. 3-6, the heel and toe side connectors 110, 120 are linear rods extending approximately parallel with one another and the rear surface 36 of the striking face section 30, such that the spacing between the heel and toe side connectors 110, 120 along the Y-axis remains constant. In the preferred embodiment, however, shown in FIG. 7, each of the heel and toe side connectors 110, 120 has a curved middle portion 116, 126, such that the heel and toe side connectors 110, 120 curve toward one another along the Y-axis as they intersect with the middle connector 130. In this embodiment, the middle connector 130 is a plate having a through-hole 131 approximately aligned with the face center 34, and has curved upper and lower edges 137, 138 to optimize mass distribution of the stiffening structure 100.

Figure 7:
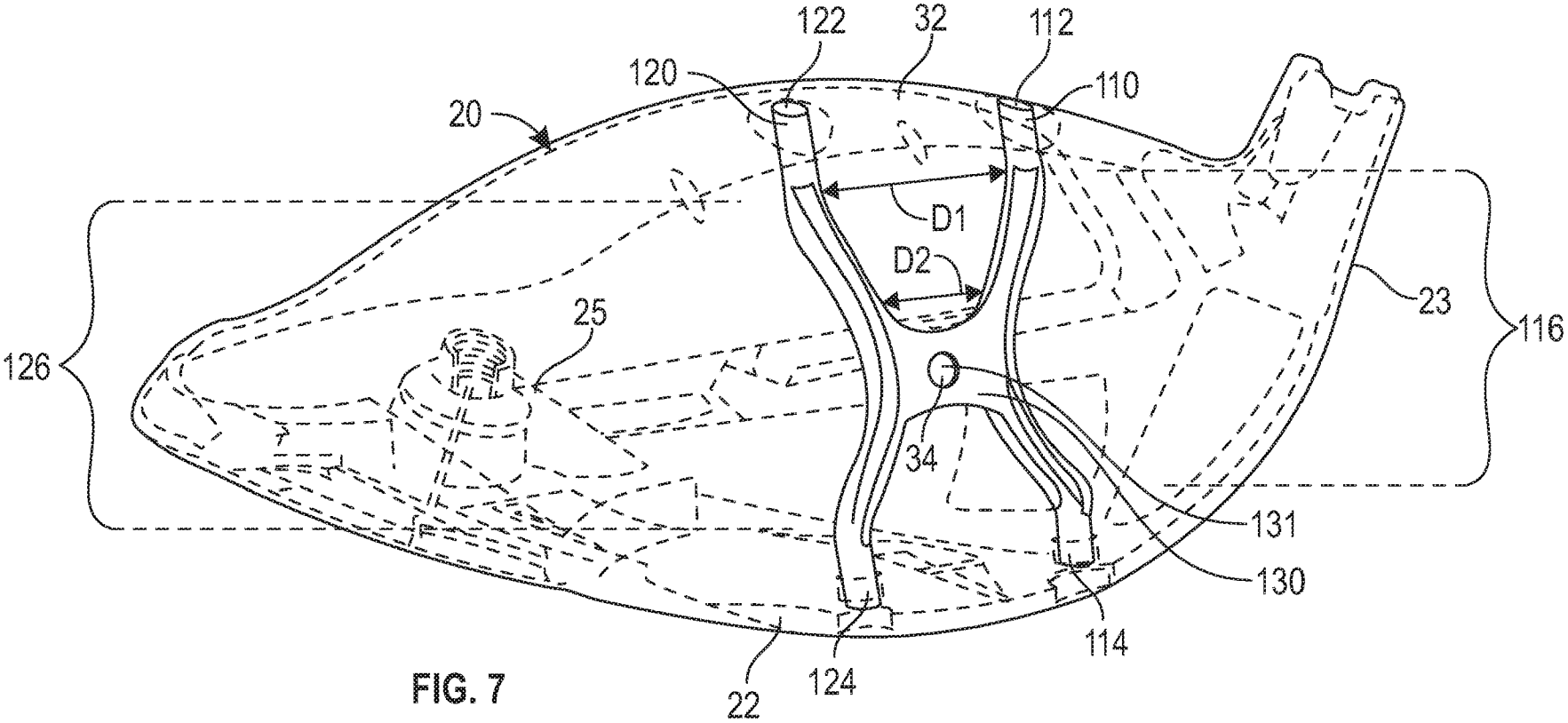
FIG. 7 is a front perspective, partially transparent view of the golf club head shown in FIG. 1 with another embodiment of the stiffening structure of the present invention.

As shown in FIG. 2, in each of the embodiments disclosed herein, the entirety of the stiffening structure 100 is located less than 0.500 inch, and more preferably less than 0.433 inch, from the rear surface 36 of the striking face section 30, measured along a vertical plane 60 extending along the vertical Z-axis and horizontal X-axis extending through the face center 34 perpendicular to the striking face section 30. No portion of the stiffening structure 100 should be disposed outside of this 0.500 inch range. Furthermore, as shown in FIG. 8, the heel and toe side connectors 110, 120 are each disposed within 1 inch, toe-wards and heel-wards, of the face center 34 along the Y-axis, though the spacing between these structures can vary if the heel and toe side connectors 110, 120 curve toward and away from each other, as shown in FIG. 7.

Figure 8:
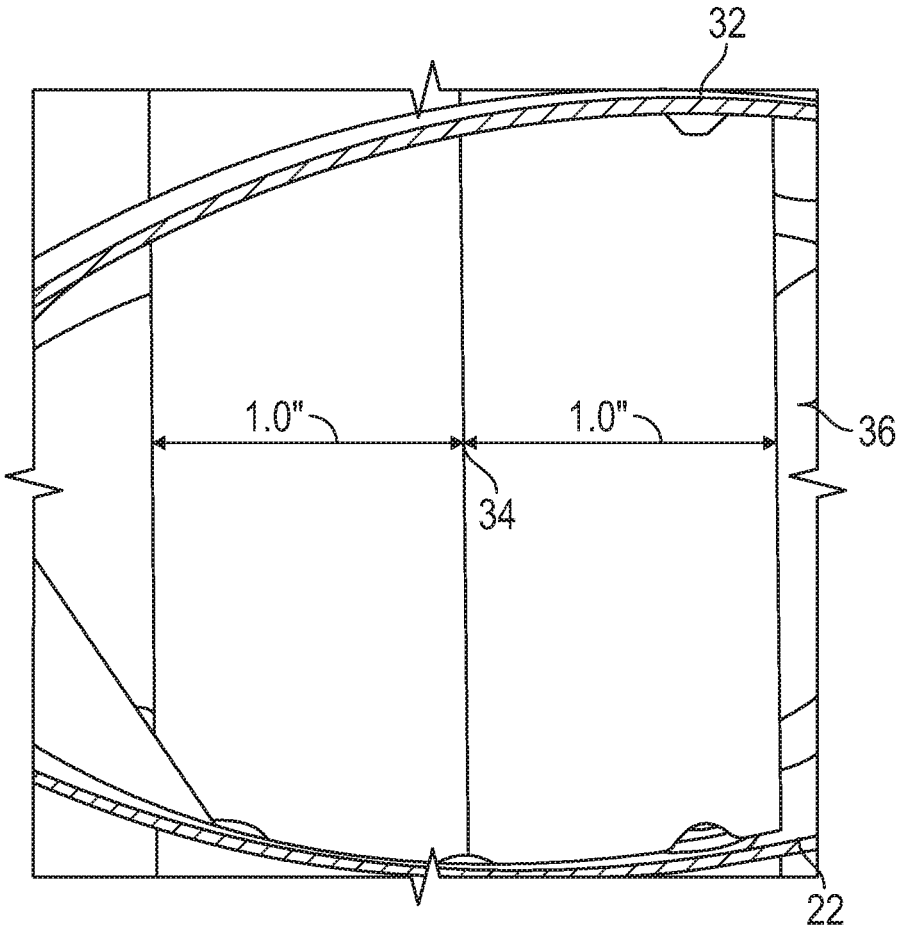
FIG. 8 is another cross-sectional view of the embodiment shown in FIG. 1 along lines 8-8.

Locating the stiffening structure 100 as defined above and in FIGS. 2 and 8 has the greatest stress-reducing effect on the golf club head 10, and allows the thickness of the striking face section 30 to be reduced, thus freeing up discretionary mass. If any portion of the stiffening structure 100 is placed more than 0.500 inch away from the rear surface 36 of the striking face section 30 or outside of the 1 inch range from the face center 35 along the Y-axis, it will not have a noticeable effect on the stress placed on the striking face section 30 when the golf club head 10 is in use, and will use up mass without creating a significant performance benefit.

As shown in the Figures, the heel and toe side connectors 110, 120 preferably are solid, approximately cylindrical rods composed of a lightweight, strong metal material such as titanium alloy or steel, though in an alternative embodiment the heel and toe side connectors 110, 120 each may be a hollow tube made of a strong lightweight metal or a composite material. In another embodiment, the golf club head 10 may include one or more of both the solid rod and hollow tube types of heel and toe side connectors 110, 120. In the preferred embodiment, each of the heel and toe side connectors 110, 120 preferably has a diameter ranging from 0.050 inch to 0.200 inch and a length ranging from 1 to 2.5 inches.

The heel and toe side connectors 110, 120, of the stiffening structure 100 may be composed of any strong material, but preferably are composed of the same material as that of the body 20 of the golf club head 10, which may be steel or titanium alloy. In any of the embodiments shown herein, the middle connector 130 may be composed of carbon composite, steel, titanium alloy, plastic, or other such materials, but is preferably co-cast with the heel and toe side connectors 110, 120 from the same material(s) used to make those portions of the stiffening structure 100. In any event, it is critical that the stiffening structure 100 have an overall mass of less than 10 grams, and more preferably less than 8 grams, in order to conserve discretionary mass and avoid undesirable changes to the mass properties (such as center of gravity location) of the golf club head 10.

In each of the embodiments disclosed herein, the golf club head 10 preferably has a Characteristic Time (CT) of the face close to, but not exceeding, the 257 microsecond ("μS") limit set by the USGA.

In any of the embodiments disclosed herein, when the golf club head 10 is designed as a driver, it preferably has a volume from 200 cubic centimeters to 600 cubic centimeters, more preferably from 300 cubic centimeters to 500 cubic centimeters, and most preferably from 420 cubic centimeters to 470 cubic centimeters, with a most preferred volume of 460 cubic centimeters. In the preferred embodiment, the golf club head 10 has a volume of approximately 450 cc to 460 cc. The volume of the golf club head 10 will also vary between fairway woods (preferably ranging from 3-woods to eleven woods) with smaller volumes than drivers.

When designed as a driver, the golf club head 10 preferably has a mass of no more than 215 grams, and most preferably a mass of 180 to 215 grams; when designed as a fairway wood, the golf club head 10 preferably has a mass of 135 grams to 200 grams, and preferably from 140 grams to 165 grams.

In each of the embodiments disclosed herein, the striking face section 30 preferably has a varying thickness such as that described in U.S. Pat. No. 7,448,960, for a Golf Club Head With Variable Face Thickness, which pertinent parts are hereby incorporated by reference. Other alternative embodiments of the thickness of the striking face section 30 are disclosed in U.S. Pat. No. 6,398,666, for a Golf Club Striking Plate With Variable Thickness, U.S. Pat. No. 6,471,603, for a Contoured Golf Club Face and U.S. Pat. No. 6,368,234, for a Golf Club Striking Plate Having Elliptical Regions Of Thickness, all of which are owned by Callaway Golf Company and which pertinent parts are hereby incorporated by reference. Alternatively, the striking face section 30 may have a uniform thickness.

In each of the embodiments disclosed herein, the body 20 is preferably cast from molten metal in a method such as the well-known lost-wax casting method. The metal for casting is preferably titanium or a titanium alloy such as 6-4 titanium alloy, alpha-beta titanium alloy or beta titanium alloy for forging, and 6-4 titanium for casting. Alternatively, the body 20 is composed of 17-4 steel alloy. Additional methods for manufacturing the body 20 include forming the body 20 from a flat sheet of metal, super-plastic forming the body from a flat sheet of metal, machining the body 20 from a solid block of metal, electrochemical milling the body 20 from a forged pre-form, casting the body using centrifugal casting, casting the body 20 using levitation casting, and like manufacturing methods.

In other embodiments, the golf club head 10 may have a multi-material composition such as any of those disclosed in U.S. Pat. Nos. 6,244,976, 6,332,847, 6,386,990, 6,406,378, 6,440,008, 6,471,604, 6,491,592, 6,527,650, 6,565,452, 6,575,845, 6,478,692, 6,582,323, 6,508,978, 6,592,466, 6,602,149, 6,607,452, 6,663,504, 6,669,578, 6,739,982, 6,758,763, 6,860,824, 6,994,637, 7,025,692, 7,070,517, 7,112,148, 7,118,493, 7,121,957, 7,125,344, 7,128,661, 7,163,470, 7,226,366, 7,252,600, 7,258,631, 7,314,418, 7,320,646, 7,387,577, 7,396,296, 7,402,112, 7,407,448, 7,413,520, 7,431,667, 7,438,647, 7,455,598, 7,476,161, 7,491,134, 7,497,787, 7,549,935, 7,578,751, 7,717,807, 7,749,096, and 7,749,097, the disclosure of each of which is hereby incorporated in its entirety herein.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim:

1. A golf club head comprising:

a body comprising a striking face section, a sole section extending away from a lower edge of the striking face section, a crown section extending away from an upper edge of the striking face section, and a hollow interior defined by the striking face section, sole section, and crown section;

a heel side boss and a toe side boss extending from at least one of the sole section and the crown section into the hollow interior; and a stiffening structure comprising a heel side connector, a toe side connector, and a middle connector, wherein the striking face section comprises a face center and a rear face surface facing the hollow interior, and wherein each of the heel side connector and toe side connector extends from the crown section to the sole section within the hollow interior approximately parallel with the rear face surface without contacting the rear face surface, wherein an end of the heel side connector is received within the heel side boss, wherein an end of the toe side connector is received within the toe side boss, wherein the middle connector connects the heel side connector to the toe side connector, wherein at least a portion a portion of the middle connector is aligned with the face center along the X-axis, wherein the entire stiffening structure is located a first distance of less than 0.500 inch from the rear face surface, wherein the first distance is measured along a plane extending through the face center, the plane extending along a vertical Z-axis and a horizontal X-axis extending perpendicular to the striking face section, wherein the golf club head has a volume of 420 cubic centimeters to 470 cubic centimeters, wherein the stiffening structure has a mass of less than 10 grams, and wherein the stiffening structure reduces stress placed on the striking face section when the striking face section impacts a golf ball.

2. The golf club head of claim 1, wherein the stiffening structure has a shape selected from the group consisting of X-shape and H-shape.

3. The golf club head of claim 1, wherein the middle connector extends approximately perpendicular to the heel side and toe side connectors.

4. The golf club head of claim 1, wherein the middle connector comprises a central section and a plurality of trusses, and wherein each of the plurality of trusses extends at an angle of less than 90° with respect to at least one of the heel side connector and the toe side connector.

5. The golf club head of claim 1, wherein the middle connector is a plate comprising at least one through-hole.

6. The golf club head of claim 5, wherein the middle connector comprises first and second triangular cutouts.

7. The golf club head of claim 1, wherein each of the heel side and toe side connector is a linear rod, and wherein the heel side connector extends approximately parallel with the toe side connector.

8. The golf club head of claim 1, wherein each of the heel and toe connectors is located a second distance of no more than 1 inch away from the center of the face, the second distance measured along a Y-axis extending parallel with the face and perpendicular to the X and Z axes.

9. The golf club head of claim 1, wherein at least one of the heel side and toe side connector comprises a curvature.

10. The golf club head of claim 9, wherein a portion of the heel side connector curves towards the toe side connector, and wherein a portion of the toe side connector curves towards the heel side connector.

11. The golf club head of claim 1, wherein the crown section comprises a heel side aperture and a toe side aperture, wherein an upper end of the heel side connector is disposed within the heel side aperture, and wherein an upper end of the toe side connector is disposed within the toe side aperture.

12. The golf club head of claim 1, wherein each of the heel side and toe side connectors is a solid cylindrical rod.

13. The golf club head of claim 1, wherein the first distance is less than 0.433 inch.

14. The golf club head of claim 1, wherein the stiffening structure has a mass of less than 8 grams.

15. The golf club head of claim 1, wherein the striking face section has a varying thickness.

16. The golf club head of claim 1, wherein at least one of the heel and toe side connectors is a hollow tube.

17. The golf club head of claim 1, wherein the middle connector does not make contact with upper or lower ends of the heel and toe side connectors.

18. The golf club head of claim 1, wherein the middle connector has an approximately constant thickness.

19. The golf club head of claim 1, wherein the middle connector has a variable thickness.

20. The golf club head of claim 1, wherein the striking face section has a characteristic time of approximately 257 microseconds.

* * * * *